US008282370B2

(12) United States Patent
Sato et al.

(10) Patent No.: US 8,282,370 B2
(45) Date of Patent: Oct. 9, 2012

(54) STEPPED SCROLL COMPRESSOR WITH CHANGING STEP MESH GAPS

(75) Inventors: Hajime Sato, Aichi (JP); Susumu Matsuda, Aichi (JP); Hisao Mizuno, Aichi (JP); Yougo Takasu, Aichi (JP); Taichi Tateishi, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 865 days.

(21) Appl. No.: 12/442,256

(22) PCT Filed: Dec. 20, 2006

(86) PCT No.: PCT/JP2006/325341

§ 371 (c)(1),
(2), (4) Date: Mar. 20, 2009

(87) PCT Pub. No.: WO2008/075415

PCT Pub. Date: Jun. 26, 2008

(65) Prior Publication Data

US 2009/0280019 A1 Nov. 12, 2009

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |

(52) U.S. Cl. ..... 418/55.2; 418/55.1

(58) Field of Classification Search ..... 418/55.2, 418/55.1

See application file for complete search history.

(56) References Cited

U.S. PATENT DOCUMENTS

| | | | | |
|---|---|---|---|---|
| 5,791,887 | A * | 8/1998 | Williams et al. | 418/55.2 |
| 6,527,531 | B2 * | 3/2003 | Fujita et al. | 418/55.2 |
| 7,497,674 | B2 * | 3/2009 | Tateishi et al. | 418/55.2 |
| 8,092,199 | B2 * | 1/2012 | Mizuno et al. | 418/55.2 |
| 2002/0114720 | A1 | 8/2002 | Itoh et al. | |

FOREIGN PATENT DOCUMENTS

| | | | |
|---|---|---|---|
| JP | 5-71477 | A | 3/1993 |
| JP | 05071477 | A * | 3/1993 |
| JP | 2002-70766 | A | 3/2002 |
| JP | 2003-35285 | A | 2/2003 |
| JP | 2006-342775 | A | 12/2006 |

OTHER PUBLICATIONS

International Search Report of PCT/JP2006/325341, date of mailing Mar. 6, 2007.

* cited by examiner

*Primary Examiner* — Mary A Davis
(74) *Attorney, Agent, or Firm* — Westerman, Hattori, Daniels & Adrian, LLP

(57) ABSTRACT

A scroll compressor having an improved compression efficiency by optimizing a step mesh gap in an operating state is provided. The scroll compressor having a step-like shape has a step-mesh-gap set value occurring between step side surfaces of a connecting wall of a fixed scroll and a connecting edge of a revolving scroll and a step-mesh-gap set value occurring between step side surfaces of a connecting walls of the revolving scroll and a connecting edge of the fixed scroll, and a fixed-side set value for when the two move close together due to the revolving scroll tilting by receiving gas pressure during operation is set greater than that for when the two move apart.

2 Claims, 8 Drawing Sheets

STEPPED SCROLL COMPRESSOR WITH CHANGING STEP MESH GAPS

TECHNICAL FIELD

The present invention relates to scroll compressors applied to, for example, air conditioners and refrigerators.

BACKGROUND ART

In a scroll compressor, spiral walls of a fixed scroll and a revolving scroll are interlocked, and the revolving scroll orbitally revolves around the fixed scroll so as to gradually reduce the volume of a compression chamber formed between the walls to compress a fluid inside the compression chamber. In such scroll compressors, since it is possible to improve the compression ability by increasing the compression ratio without increasing the size of the compressor itself, a scroll compressor with a scroll member having a step-like shape is put to actual use (for example, refer to Patent Document 1.

Patent Document 1: Japanese Unexamined Patent Application, Publication No. 2003-35285

DISCLOSURE OF INVENTION

In order to permit revolution of the revolving scroll at the above-described stepped section of the scroll member, a minute gap is formed between the fixed scroll and the revolving scroll. Consequently, as the volume of the compression chamber gradually decreases as the compression process proceeds, compression gas leaks through the minute gap from the high-pressure side to the low-pressure side. Therefore, the minute gap formed at the stepped section causes a reduction in the compression efficiency of the scroll compressor.

A gap known as a "step mesh gap" is provided at the stepped section of a scroll compressor employing a step-like shape to serve as such a minute gap that acts as a leakage path of the compression gas. The step mesh gaps are gaps formed between the stepped sections (between the connecting edge and the connecting wall) of the bottom side and the tip side of the stepped section having a step-like shape. The two step mesh gaps in the scroll compressor are set to be equal when the operation is stopped.

However, with the above-described step mesh gaps, when the scroll compressor is operated and the revolving scroll starts the compression operation, one of the step mesh gaps becomes small due to the tilting of the revolving scroll, whereas the other becomes large due to separation. From such a viewpoint, there is a need for improving the efficiency by optimizing the step mesh gaps during operation of the scroll compressor and reducing the leakage amount of compressed gas that leaks from the high-pressure side to the low-pressure side through the step mesh gaps during operation.

The present invention has been conceived in light of the problems described above, and it is an object thereof to provide a scroll compressor having an improved compression efficiency by optimizing step mesh gaps in an operating state.

To solve the problems described above, the present invention provides the following solutions.

A scroll compressor according to the present invention includes a fixed scroll having a spiral wall vertically provided on one side surface of an end plate, and a revolving scroll having spiral wall vertically provided on one side surface of an end plate and being supported in such a manner as to be capable of orbitally revolving while rotation is prevented by meshing the walls, wherein a stepped section is formed on the side surface of at least one of the end plates of the fixed scroll and the revolving scroll such that the height along the spiral of the walls is high at the center portion and low at the outward end, and wherein an upper edge of the other wall of the fixed scroll or the revolving scroll, corresponding to the stepped section of the end plate is divided into a plurality of sections, and has a step-like shape such that the height of the sections is low at the center portion of the spiral and high at the outward end, wherein the scroll compressor has a first step-mesh-gap set value (Hf) occurring between step side surfaces at a bottom of the fixed scroll and a tip of the revolving scroll and a second step-mesh-gap set value (H0) occurring between a bottom of the revolving scroll and a tip of the fixed scroll, and a fixed-side set value for when the two move close together due to the revolving scroll tilting by receiving gas pressure during operation is set greater than that for when the two move apart.

With the scroll compressor according of the present invention, a first step-mesh-gap set value (Hf) occurring between step side surfaces at a bottom of the fixed scroll and a tip of the revolving scroll and a second step-mesh-gap set value (H0) occurring between a bottom of the revolving scroll and a tip of the fixed scroll are set such that a fixed-side set value for when the two move close together due to the revolving scroll tilting by receiving gas pressure during operation is set greater than that for when the two move apart; therefore, when the revolving scroll tilts by receiving gas pressure during operation, the step mesh gap when moving close together and the step mesh gap when moving away from each other can be set to substantially minimum optimal values, and thus the leakage amount from the step mesh gaps can be reduced.

It is preferable that the first and second step-mesh-gap set values (Hf and H0) be set such that a step mesh gap amount (he) formed at the end of the meshing is smaller than a step mesh gap amount (hs) formed at the beginning of the meshing (hs>he), and a step mesh gap amount (h) gradually decrease from the start of the meshing to the end of the meshing. In this way, the step mesh gap amount (h) decreases as the pressure difference becomes large. Thus, the leakage amount from the step mesh gaps can be reduced.

It is preferable that cross-sectional shapes of a bottom and a tip meshing at the stepped section be asymmetrical, with the radii of curvature varied such that the contact area increases from a meshing start time to a meshing end time. In this way, the sealing ability increases by increasing the contact area when the pressure difference is large. Thus, the leakage amount from the step mesh gaps can be reduced.

According to the above-described present invention, the step mesh gap formed between the side surfaces of the bottom side and the tip side at the stepped section having a step-like shape is optimized in the operation state, and the amount of compressed gas leaking from the step mesh gap during the compression process during operation can be reduced; therefore, a significant advantage is achieved in that the compression efficiency of the scroll compressor increases.

Moreover, by setting the step mesh gap small in the last half of the compression process when the pressure difference is large and by increasing the sealing ability by employing an asymmetrical cross-section in which the contact area of the connecting wall and the connecting edge increase in the last half of the compression process when the pressure difference is large, the compression efficiency of the scroll compressor having a stepped section with a step-like shape can be improved even more.

EXPLANATION OF REFERENCE SIGNS

1: housing
2: discharge cover
11: discharge port
12: fixed scroll
12*a*, 13*a*: end plate
12*b*, 13*b*: wall
12*c*, 12*d*, 13*c*, 13*d*: upper edge (tip)
12*e*, 13*e*: connecting edge (tip)
12*f*, 12*g*, 13*f*, 13*g*: bottom surface (bottom)
12*h*, 13*h*: connecting wall (bottom)
13: revolving scroll
42, 43: stepped section
C: compression chamber
Hf, H0: step-mesh-gap set value
h, hs, he: step mesh gap amount

BEST MODE FOR CARRYING OUT THE INVENTION

An embodiment of a scroll compressor according to the present invention will be described below with reference to the drawings.

Figure 3:
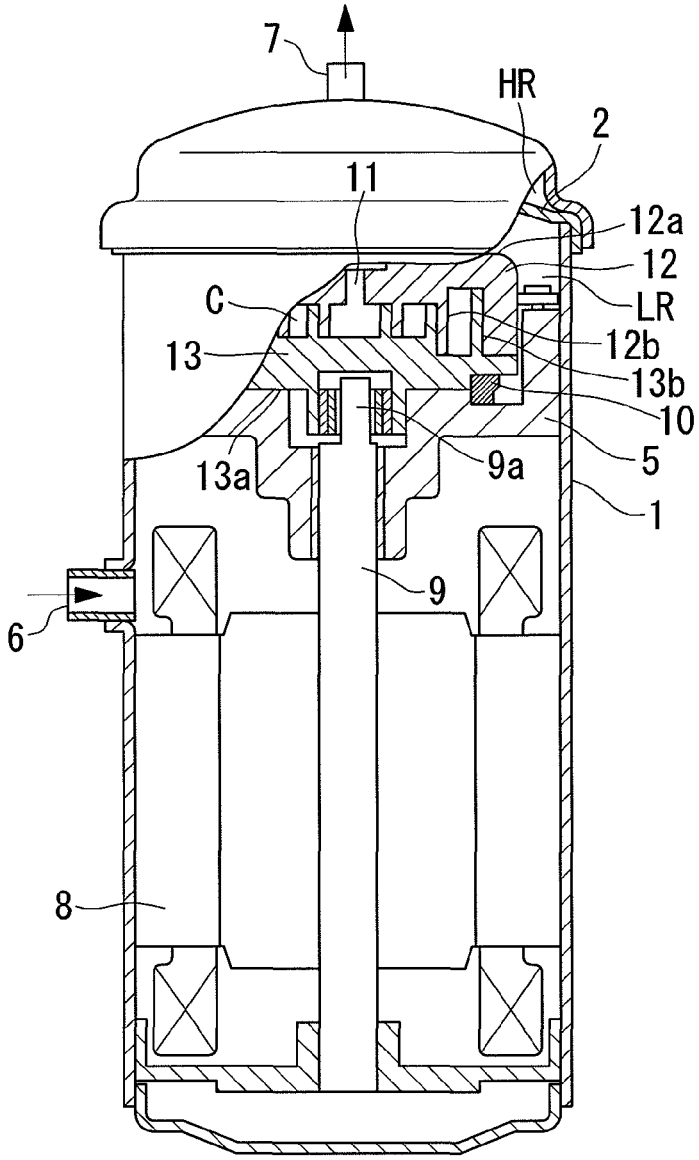
FIG. 3 is a partial sectional view of an example configuration of a scroll compressor according to the present invention.

FIG. 3 is a sectional view of an example configuration of a scroll compressor. In the drawing, reference numeral 1 represents a sealed housing, reference numeral 2 represents a discharge cover that partitions the interior of the housing 1 into a high-pressure chamber HR and a low-pressure chamber LR, reference numeral 5 represents a frame, reference numeral 6 represents an intake pipe, reference numeral 7 represents a discharge pipe, reference numeral 8 represents a motor, reference numeral 9 represents a rotary shaft, and reference numeral 10 represents a rotation prevention mechanism. Moreover, reference numeral 12 represents a fixed scroll, and reference numeral 13 represents a revolving scroll meshed with the fixed scroll 12.

Figure 4A:
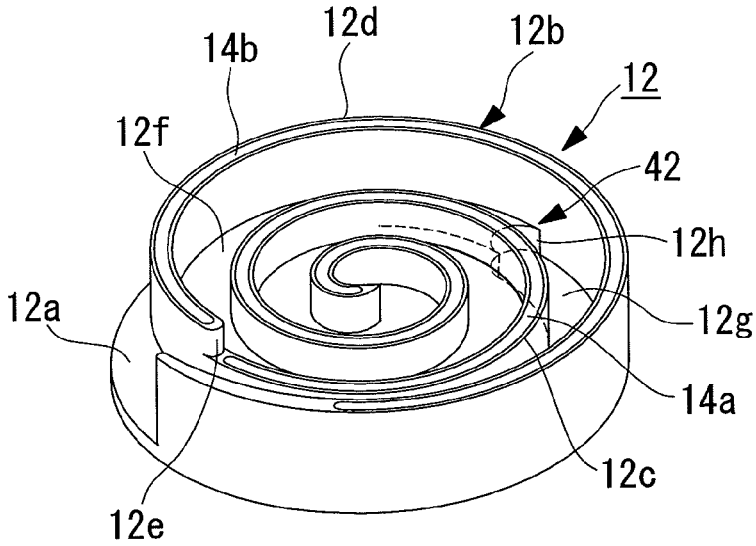
FIG. 4A is a perspective view of an example configuration of a scroll compressor according to the present invention with a fixed scroll vertically inverted.
Figure 4B:
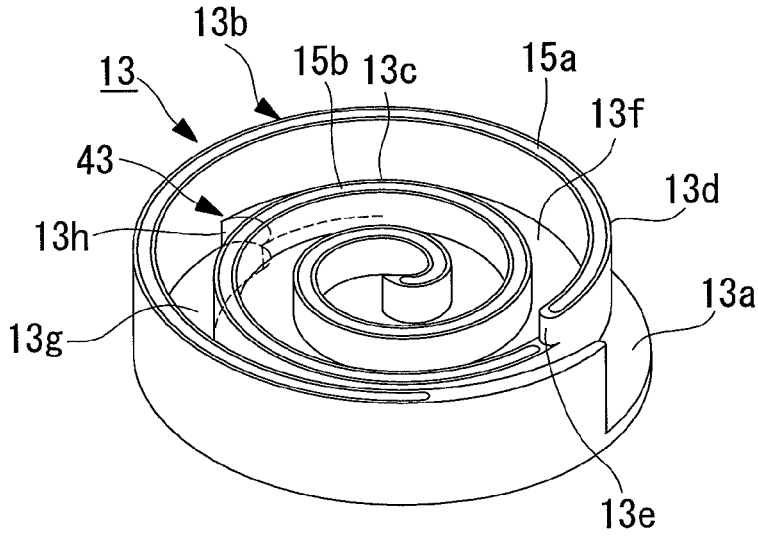
FIG. 4B is a perspective view of an example configuration of a revolving scroll of a scroll compressor according to the present invention.

As shown in FIG. 4, the fixed scroll 12 is constructed by vertically mounting a spiral wall 12*b* on one side of an end plate 12*a*. As shown in FIG. 4B, the revolving scroll 13 is constructed, in the same manner as the fixed scroll 12, by vertically mounting a spiral wall 13*b* on one side of an end plate 13*a*. In particular, the wall 13*b* has substantially the same shape as the wall 12*b* of the fixed scroll 12. The revolving scroll 13 and the fixed scroll 12 are decentered relative to each other by a radius of revolution with their phases shifted by 180° and are installed by meshing the walls 12*b* and 13*b* with each other.

In such a case, the revolving scroll 13 revolves around the fixed scroll 12 by the operation of the rotation prevention mechanism 10 and a revolving eccentric pin 9*a* that is provided at the upper edge of the rotary shaft 9 driven by the motor 8. The fixed scroll 12 is fixed to the housing 1 and is provided with a discharge port 11 for compressed fluid disposed at the center of the rear side of the end plate 12*a*.

A stepped section 42, formed such that the height in the spiral direction at the center portion of the wall 12*b* is high and the height at the outward end is low, is provided on one side of the end plate 12*a* of the fixed scroll 12, where the wall 12*b* is vertically provided. Similar to the end plate 12*a* of the fixed scroll 12, the end plate 13*a* of the revolving scroll 13, where the wall 13*b* is vertically provided, is provided with a stepped section 43, formed such that the height in the spiral direction at the center portion of the wall 13*b* is high and the height at the outward end is low. The stepped sections 42 and 43 are provided at positions shifted by π (rad) from the outward ends (intake side) to the inward ends (discharge side) of the walls 12*b* and 13*b*.

The bottom surface of the end plate 12*a* is divided into two sections by the stepped section 42: a shallow bottom surface 12*f* adjoining the center portion and a deep bottom surface 12*g* adjoining the outer end. The adjacent bottom surfaces 12*f* and 12*g* constitute the stepped section 42, and a connecting wall 12*h* connecting the bottom surfaces 12*f* and 12*g* is vertically provided.

Similar to the above-described end plate 12*a*, the end plate 13*a* is divided into two sections by the stepped section 43: a shallow bottom surface 13*f* adjoining the center portion and a deep bottom surface 13*g* adjoining the outer end. The adjacent bottom surfaces 13*f* and 13*g* constitute the stepped section 43, and a connecting wall 13*h* connecting the bottom surfaces 13*f* and 13*g* is vertically provided.

The wall 12*b* of the fixed scroll 12 corresponds to the stepped section 43 of the revolving scroll 13, and the spiral upper edge thereof is divided into two sections and has a step-like shape in which the height of the center portion is high and the height of the outer end is low. Similar to the wall 12*b*, the wall 13*b* of the revolving scroll 13 corresponds to the stepped section 42 of the fixed scroll 12, and the spiral upper edge thereof is divided into two sections and has a step-like shape in which the height of the center portion is high and the height of the outer end is low.

More specifically, the upper edge of the wall 12*b* is separated into two sections: a low upper edge 12*c* provided closer to the center portion and a high upper edge 12*d* provided closer to the outward end. A vertical connecting edge 12*e* connecting the adjacent upper edges 12*c* and 12*d* is provided therebetween. Similar to the above-described wall 12*b*, the upper edge of the wall 13*b* is separated into two sections: a low upper edge 13*c* provided closer to the center portion and a high upper edge 13*d* provided closer to the outward end. A vertical connecting edge 13*e* connecting the adjacent upper edges 13*c* and 13*d* is provided therebetween.

The connecting edge 12*e* smoothly continues to the outer and inner sides of the wall 12*b* when viewed from the revolving scroll 13 direction of the wall 12*b* and forms a semicircle having a diameter equal to the thickness of the wall 12*b*. Similar to the connecting edge 12*e*, the connecting edge 13*e* smoothly continues to the outer and inner sides of the wall 13*b* and forms a semicircle having a diameter equal to the thickness of the wall 13*b*.

When viewed from the revolving axis direction of the end plate 12*a*, the connecting wall 12*h* forms an arc that aligns with the envelope curve formed by the connecting edge 13*e* while the revolving scroll revolves. Similar to the connecting wall 12*h*, the connecting wall 13*h* aligns with the envelope curve formed by the connecting edge 12*e*.

On the wall 12*b* of the fixed scroll 12, tip seals 14*a* and 14*b*, which are divided into two near the connecting edge 12*e*, are provided at the upper edges 12*c* and 12*d*. Similarly, on the wall 13*b* of the revolving scroll 13, tip seals 15*a* and 15*b*, which are divided into two near the connecting edge 13*e*, are provided at the upper edges 13*c* and 13*d*. The tip seals seal tip-seal gaps formed between the upper edge (tip) and the bottom surface (bottom) between the revolving scroll 13 and minimize compressed gas/fluid leakage.

Specifically, when the revolving scroll 13 is meshed with the fixed scroll 12, the tip seal 15*b* provided at the low upper edge 13*c* contacts the shallow bottom surface 12*f*, and the tip seal 15*a* provided at the high upper edge 13*d* contacts the deep bottom surface 12*g*. At the same time, the tip seal 14*a* provided at the low upper edge 12*c* contacts the shallow bottom surface 13*f*, and the tip seal 14*b* provided at the high upper edge 12*d* contacts the deep bottom surface 13*g*. As a result, compression chambers C are formed between the scrolls 12 and 13 and are partitioned by the end plates 12*a* and 13*a* and the walls 12*b* and 13*b* facing each other. In FIG. 4A, the top and bottom of the fixed scroll 12 are inverted so as to show the step-like shape of the fixed scroll 12.

Figure 5:
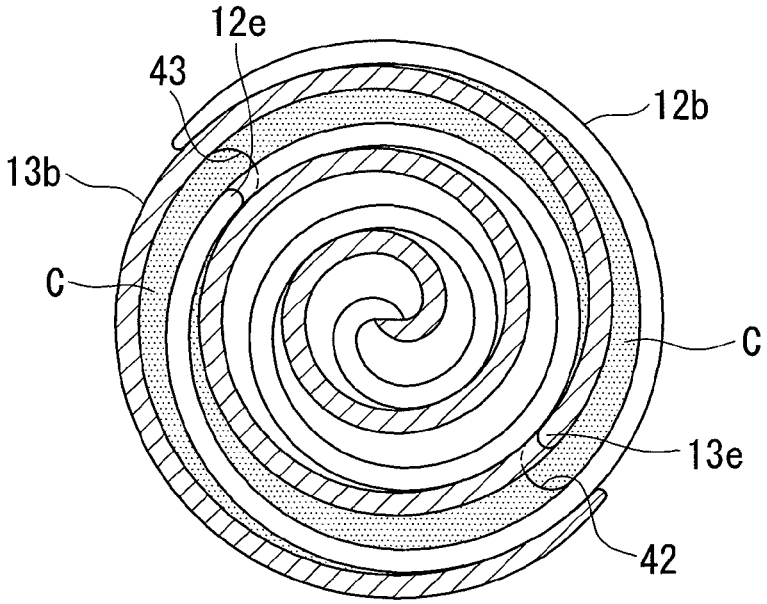
FIG. 5 is a sectional view of a state at the beginning of compression where a compression chamber is formed by interlocking a fixed scroll and a revolving scroll.

FIG. 5 illustrates the compression chambers C, formed by interlocking the fixed scroll 12 and the revolving scroll 13*a*, in a compression start state. In this compression start state, the outward end of the wall 12*b* contacts the outer surface of the wall 13*b*, the outward end of the wall 13*b* contacts the outer surface of the wall 12*b*, fluid to be compressed is sealed between the end plates 12*a* and 13*a* and the walls 12*b* and 13*b*, and two compression chambers C having maximum volume are formed at positions facing each other on either side of the center of the scroll compressor mechanism. At this point, the connecting edge 12*e* and the connecting wall 13*h*, and the connecting edge 13*e* and the connecting wall 12*h* are sliding against each other. However, they are moved apart immediately after the revolving operation of the fixed scroll 12.

Figure 1A:
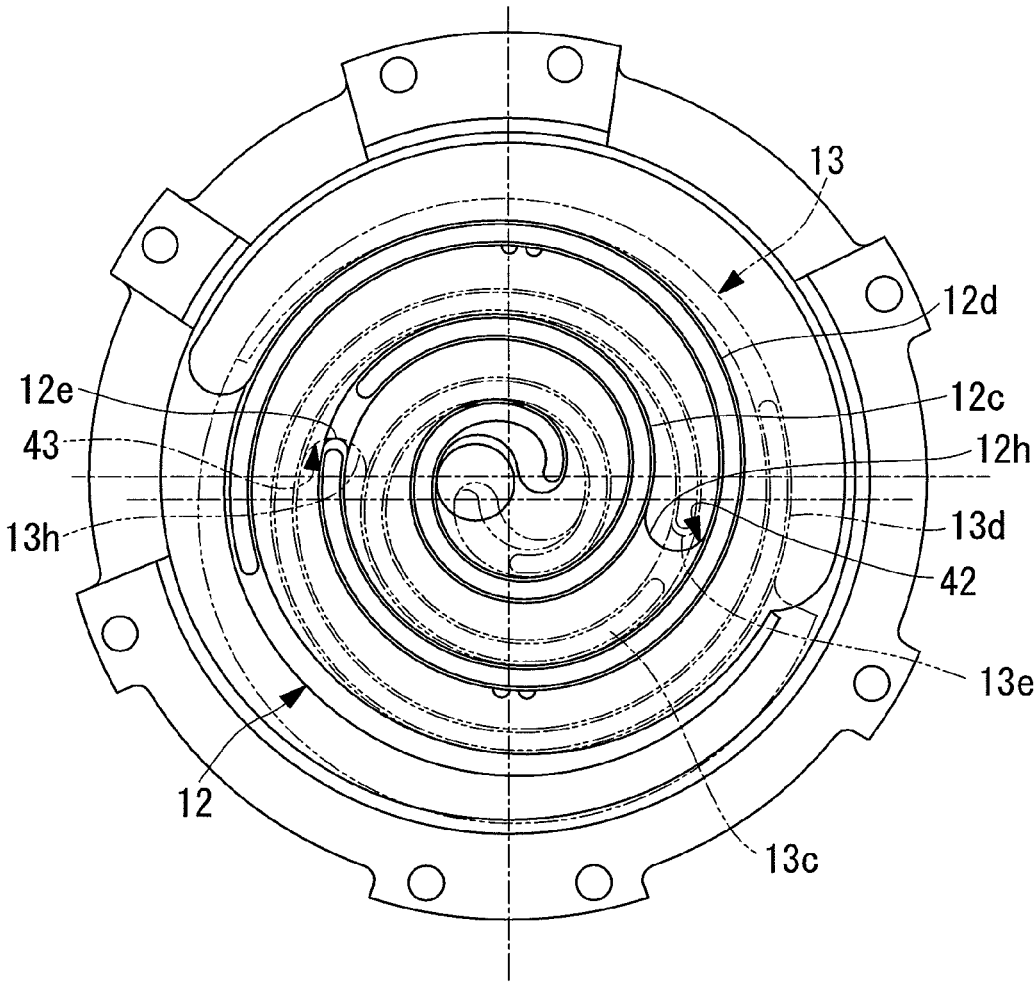
FIG. 1A is a plan view of an embodiment of a scroll compressor according to the present invention in a meshing state of a fixed scroll and a revolving scroll when operation is stopped.
Figure 1B:
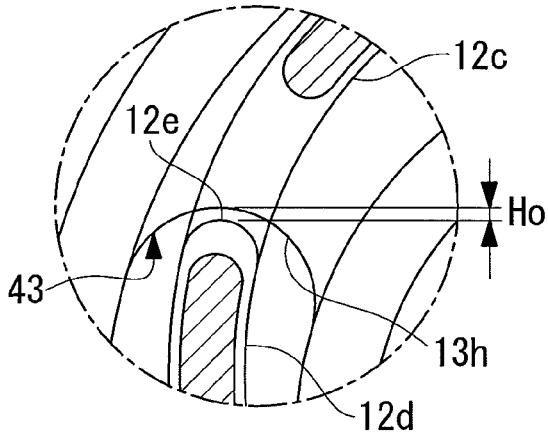
FIG. 1B is an enlarged view of a stepped section 43 and its periphery in FIG. 1A.
Figure 1C:
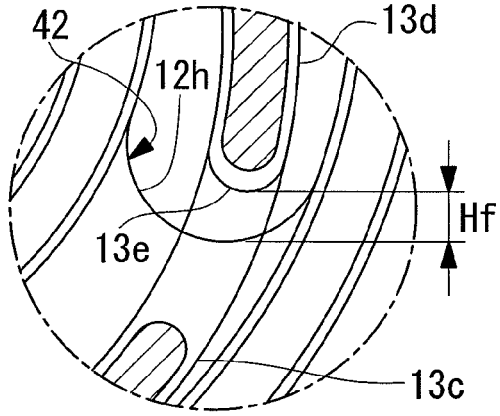
FIG. 1C is an enlarged view of a stepped section 42 and its periphery in FIG. 1A.

When the above-described fixed scroll 12 and revolving scroll 13 are in an interlocked state, step-mesh-gap set values H0 and Hf (see FIGS. 1B and 1C) at the two stepped sections 42 and 43 set as described below when operation is stopped with no load applied. The step mesh gaps are gaps formed in the stepped sections 42 and 43, between connecting edges 12*e* and 13*e*, which are step side surfaces on the tip sides, and the connecting walls 12*h* and 13*h*, which are side surfaces of the step sections on the bottom sides.

Specifically, when a first step-mesh-gap set value (hereinafter referred to as "fixed-side set value") Hf generated between the step side surfaces of the connecting wall (tip-side step wall) 12*h* of the fixed scroll 12 and the connecting edge (bottom-side step wall) 13*e* of the revolving scroll 13 at the stepped section 42 is compared with a second step-mesh-gap set value (hereinafter referred to as "revolving-side set value") H0 generated between the step side surfaces of the connecting wall 13*h* (step wall on bottom side) of the revolving scroll 13 and the connecting edge (step wall on tip side) 12*e* of the fixed scroll 12 at the stepped section 43, the fixed-side set value Hf for when the two move close together due to the revolving scroll 13 tilting by receiving gas pressure during operation is set greater than the revolving-side set value H0 for when the two move apart (Hf>H0).

Figure 2A:
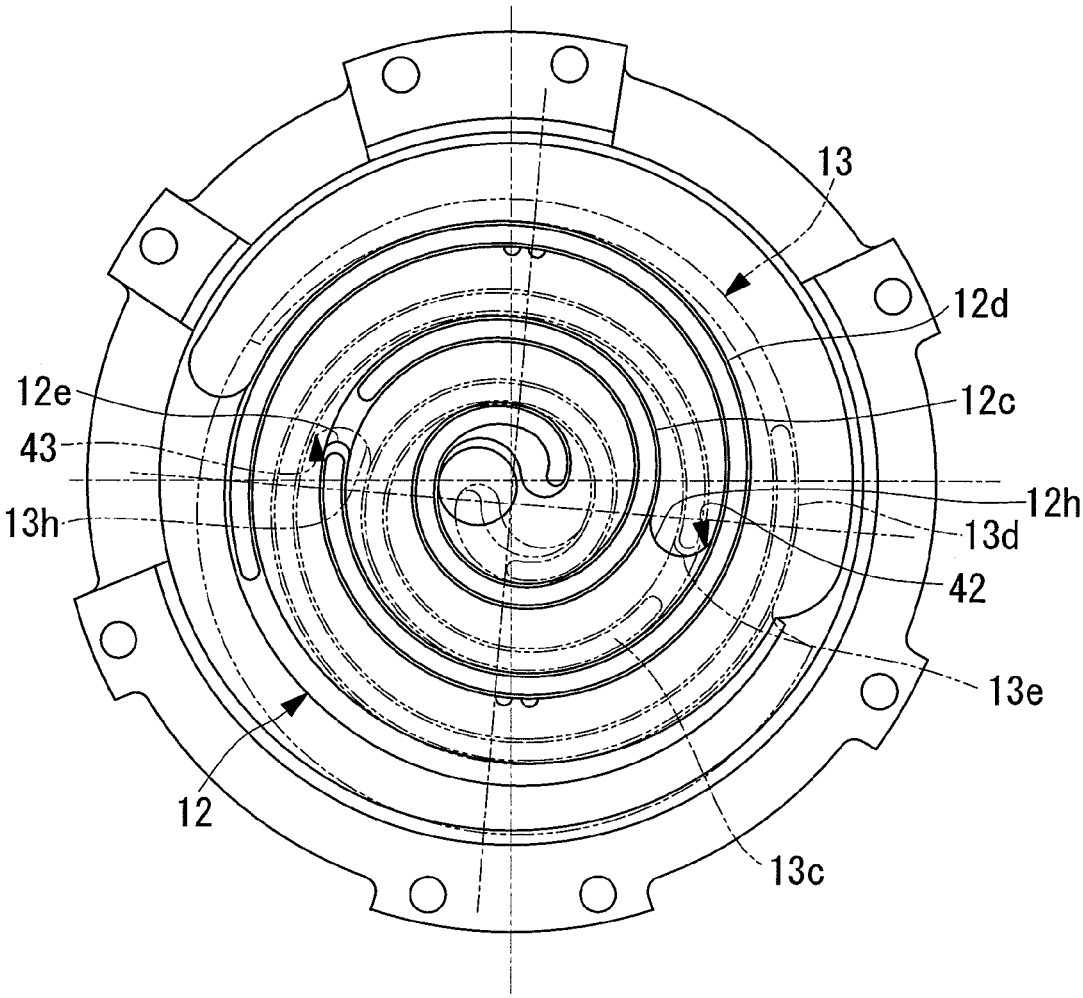
FIG. 2A is a plan view of an embodiment of a scroll compressor according to the present invention in a meshing state of a fixed scroll and a revolving scroll when operation is stopped.
Figure 2B:
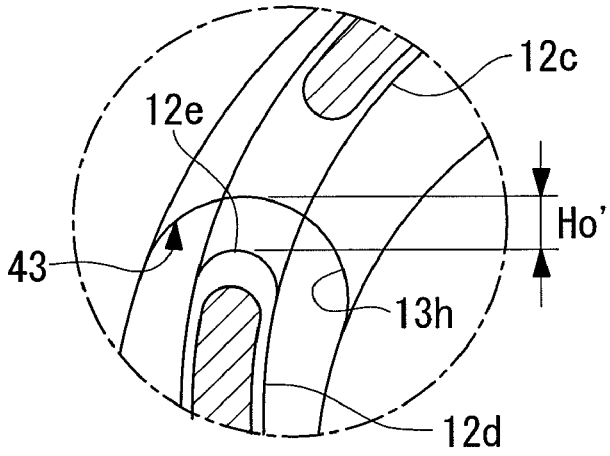
FIG. 2B is an enlarged view of a stepped section 43 and its periphery in FIG. 2A.
Figure 2C:
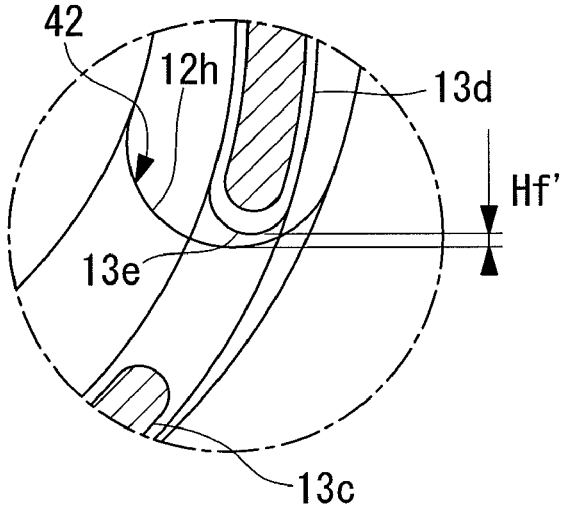
FIG. 2C is an enlarged view of a stepped section 42 and its periphery in FIG. 2A.

When the above-described scroll compressor starts operation, the revolving scroll 13 slightly tilts to the right in the plane of the drawing (clockwise) by receiving gas pressure, as shown in FIGS. 2A to 2C. Therefore, the fixed-side set value Hf and the revolving-side set value H0 set during the stopped state shown in FIGS. 1A to 1C change to a fixed-side step mesh value Hf' and a revolving side step mesh value H0' due to the tilting of the revolving scroll 13.

Since the connecting edge 13*e* moves close to the connecting wall 12*h* due to the tilting of the revolving scroll 13, the fixed side step mesh value Hf' becomes smaller than the fixed-side set value Hf set in the stopped state. On the other hand, since the connecting edge 12*e* moves away from the connecting wall 13*h* due to the tilting of the revolving scroll 13, the revolving-side step mesh value H0' becomes greater than the revolving-side set value H0 set in the stopped state.

Therefore, for the step mesh gap in the stopped state with the revolving scroll 13 tilted, the fixed side step mesh value Hf' on the stepped section 42 side is smaller than that of a stopped state and the revolving side step mesh value H0' on the stepped section 43 side after moving away is smaller than usual; therefore, the revolving side and the fixed side are optimized and the overall opening area can be reduced. Consequently, the gas volume leaking from the high-pressure side to the low-pressure side through the opening area of the step mesh gap in the compression process of the scroll compressor is reduced; thus, the compression efficiency of the scroll compressor employing a step-like shape can be improved.

Figure 6:
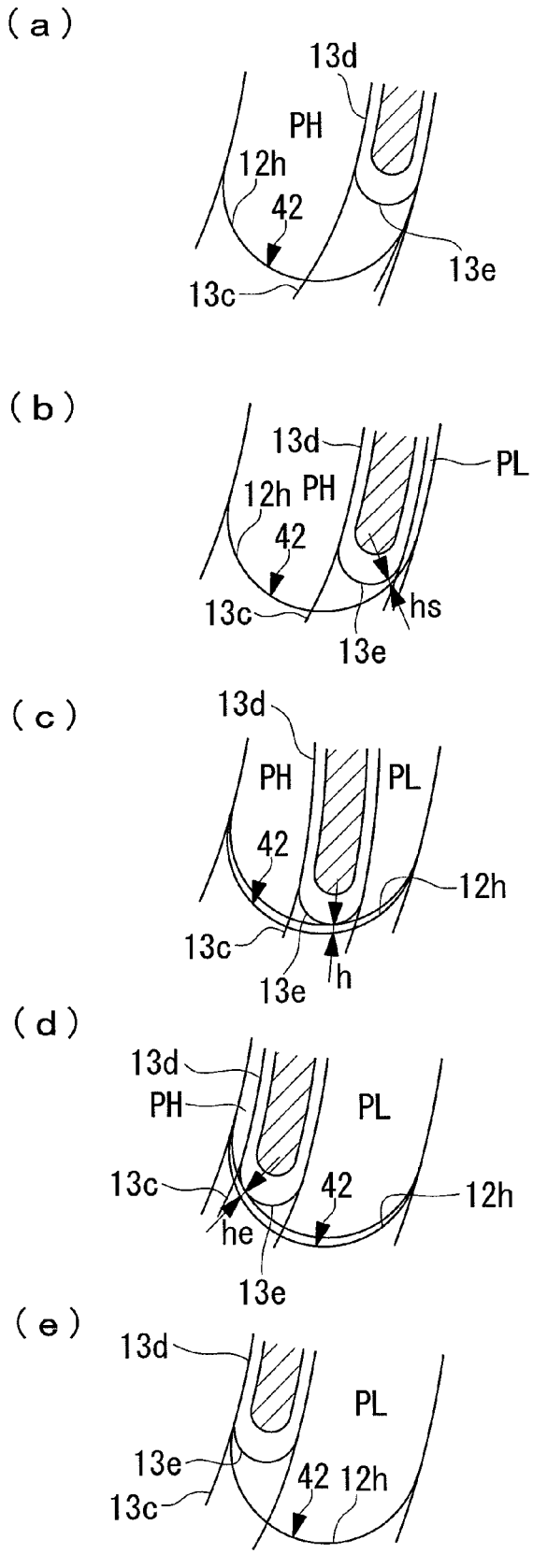
FIG. 6 is an enlarged partial view of the stepped section according to the present invention, illustrating each stage of the compression operation in which compression is started at the beginning of meshing shown in (a) and is ended in (e).

At the stepped sections 42 and 43 of the scroll compressor, the fixed-side set value Hf and the revolving-side set value H0 are set such that a step mesh gap amount he formed at the end of the meshing is smaller than a step mesh gap amount hs formed at the beginning of the meshing of the fixed scroll 12 and the revolving scroll 13 (hs>he), and a step mesh gap amount h gradually decreases from the start of the meshing to the end of the meshing, as shown in FIG. 6.

In such a case, the cross-sections of the connecting walls (bottoms) 12*h* and 13*h* and the connecting edges (tips) 12*e* and 13*e* meshing at the stepped sections 42 and 43 are substantially semicircular.

In FIG. 6, compression starts from the meshing start state illustrated in (a), proceeds through (b) to (d) as the compression process of the connecting edge 13*e* of the revolving scroll 13 proceeds, and ends in (e). In such a compression process, the compression chamber C is divided into a high-pressure side PH and a low-pressure PL by the wall 13*b* of the revolving scroll 13.

However, at the beginning of compression when the pressure difference of the high-pressure side PH and the low-pressure side PL is small, the leakage amount of compressed gas is not very large even when the step mesh gap amount h is relatively large. Then, as the compression process proceeds and the pressure difference between the high-pressure side PH and the low-pressure side PL increases, the leakage amount increases if the step mesh gap amount h is constant. However, since the step mesh gap amount h is set such that it gradually decreases, the leakage amount of compressed gas is restricted to a small amount. As a result, since the leakage amount of compressed gas through the overall compression process can be reduced, the compression efficiency of the scroll compressor employing a step-like shape can be improved.

Figure 7:
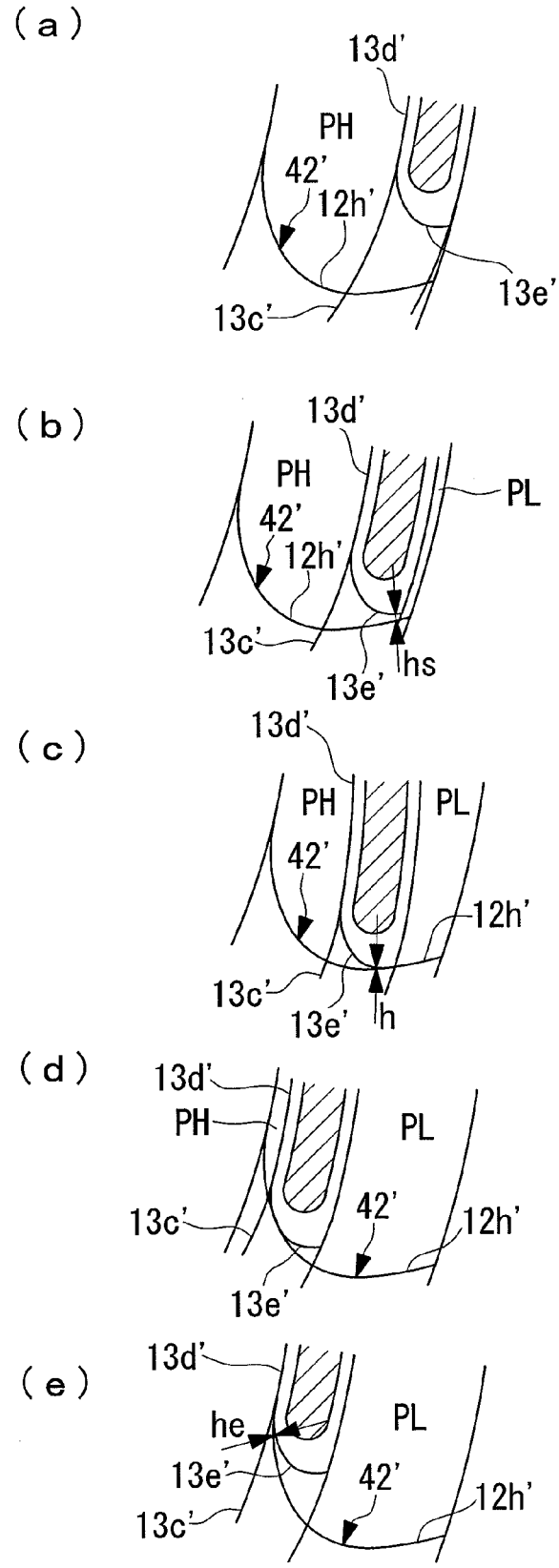
FIG. 7 is an enlarged partial view of the stepped section according to a modification of the present invention, illustrating each stage of the compression operation in which compression is started at the beginning of meshing shown in (a) and is ended in (e).

FIG. 7 illustrates a modification of the above-described FIG. 6; the cross-sections of connecting walls (bottoms) 12*h*' and 13*h*' and connecting edges (tips) 12*e*' and 13*e*' meshing at stepped sections 42' and 43' are asymmetrical with different radii of curvature such that the contact area increases from the meshing start time to the meshing end time.

In FIG. 7, compression starts from the meshing start state illustrated in (a), proceeds through (b) to (d) as the compression process of the connecting edge 13*e*' of the revolving scroll 13 proceeds, and ends in (e). In such a compression process, the compression chamber C is divided into a high-pressure side PH and a low-pressure PL by the wall 13*b* of the revolving scroll 13.

In this modification, since the radii of curvature are asymmetrical, the sealing ability is increased by increasing the contact area of the connecting walls and connecting edges when the pressure difference between the high-pressure side PH and the low-pressure side LH is large.

Specifically, in the meshing start state, since the pressure difference is small, the leakage amount is not very large even when the contact area is reduced to line contact. However, the cross-sections, having asymmetrical radii of curvature, of the connecting walls (bottoms) 12*h*' and 13*h*' and the connecting edges (tips) 12*e*' and 13*e*' are shaped such that the contact changes from line contact to surface contact as the compression process proceeds and the pressure difference increases; therefore, a sufficient sealing ability is achieved since the contact area increases in the last half of the compression process when the pressure difference is large. Consequently, the leakage amount from the step mesh gap is reduced in the last half of the compression process even when the pressure difference is large, and therefore, the compression efficiency of the scroll compressor employing a step-like shape can be improved.

In this way, with the scroll compressor according to the present invention, the step mesh gap formed between the side surfaces on the bottom side and the tip side of the stepped sections 42 and 43 having step-like shapes is optimized such that it becomes small in an operating state. As a result, the amount of compressed gas leakage from the step mesh gap in the compression process during operation can be reduced. Therefore, a significant advantage is achieved in that the compression efficiency of the scroll compressor having a stepped section with a step-like shape is improved.

The step mesh gap becomes smaller toward the last half of the compression process when the pressure difference is large. For this reason also, a significant advantage is achieved in that the compression efficiency of the scroll compressor having a stepped section with a step-like shape is improved. An asymmetrical cross-section that increases the contact area of the connecting wall and the connecting edge when the pressure difference is large is employed and the sealing ability is increased in the last half of the compression process. For this reason also, a significant advantage is achieved in that the compression efficiency of the scroll compressor having a stepped section with a step-like shape is improved.

The present invention is not limited to the embodiments described above, and various modifications may be made so long as they do not depart from the spirit of the invention.

The invention claimed is:

1. A scroll compressor comprising a fixed scroll having a spiral wall vertically provided on one side surface of an end plate, and a revolving scroll having spiral wall vertically provided on one side surface of an end plate and being supported in such a manner as to be capable of orbitally revolving while rotation is prevented by meshing the walls, wherein a stepped section is formed on the side surface of at least one of the end plates of the fixed scroll and the revolving scroll such that the height along the spiral of the walls is high at the center portion and low at the outward end, and wherein an upper edge of the other wall of the fixed scroll or the revolving scroll, corresponding to the stepped section of the end plate is divided into a plurality of sections, and has a step-like shape such that the height of the sections is low at the center portion of the spiral and high at the outward end, wherein the scroll compressor has a first step-mesh-gap set value (Hf) occurring between step side surfaces at a bottom of the fixed scroll and a tip of the revolving scroll and a second step-mesh-gap set value (H0) occurring between step side surfaces at a bottom of the revolving scroll and a tip of the fixed scroll, and a fixed-side set value for when the two move close together due to the revolving scroll tilting by receiving gas pressure during operation is set greater than that for when the two move apart, and wherein the first and second step-mesh-gap set values (Hf and H0) are set such that a step mesh gap amount (he) formed at the end of the meshing is smaller than a step mesh gap amount (hs) formed at the beginning of the meshing (hs>he), and a step mesh gap amount (h) gradually decreases from the start of the meshing to the end of the meshing.

2. The scroll compressor according to claim 1, wherein cross-sectional shapes of a bottom and a tip meshing at the stepped section are asymmetrical, with the radii of curvature varied such that the contact area increases from a meshing start time to a meshing end time.

* * * * *